United States Patent [19]

Hall

[11] Patent Number: 4,506,466

[45] Date of Patent: Mar. 26, 1985

[54] PORTABLE SHOOTER'S BENCH

[76] Inventor: Stanley J. Hall, 443 Wells Rd., Doylestown, Pa. 18901

[21] Appl. No.: 444,284

[22] Filed: Nov. 24, 1982

[51] Int. Cl.[3] ..... F41C 29/00; A47B 3/14

[52] U.S. Cl. ..... 42/94; 108/111; 108/115; 297/135; 248/166

[58] Field of Search ..... 42/94; 89/37 BA; 297/135, 139, 172, 170, 159; 312/239; 108/111, 115; 248/165, 461, 188.2, 166; D6/17, 178

[56] References Cited

U.S. PATENT DOCUMENTS

| | | | |
|---|---|---|---|
| D. 262,849 | 2/1982 | Schoenig | D6/178 |
| 414,392 | 11/1889 | Findley | 297/170 |
| 1,858,103 | 5/1932 | Menon | 297/172 |
| 2,421,127 | 5/1947 | Peckham | 155/124 |
| 2,640,750 | 6/1953 | Rohde | 312/239 X |
| 2,729,975 | 1/1956 | Hawthorne et al. | 89/37 BA |
| 2,847,909 | 8/1958 | Kester | 89/40 |
| 3,125,929 | 3/1964 | Peasley | 297/135 X |
| 3,711,984 | 1/1973 | Dyer et al. | 42/94 |
| 3,863,376 | 2/1975 | Dalmaso | 42/94 |
| 3,885,829 | 5/1975 | Haeger | 297/139 X |
| 4,144,823 | 3/1979 | Rathert | 297/159 |
| 4,296,963 | 10/1981 | Blanchard et al. | 297/135 X |
| 4,438,581 | 3/1984 | LaValle | 42/94 |

FOREIGN PATENT DOCUMENTS 1147375 6/1957 France ..... D6/178 X

OTHER PUBLICATIONS

Dec. 1981, issue of The American Hunter, pp. 58 and 59.

*National Defense,* vol. 68, No. 395, (Feb. 1984), p. 72, "Shooter's Sidekick".

*Primary Examiner*—Stephen C. Bentley
*Assistant Examiner*—John S. Maples
*Attorney, Agent, or Firm*—Howson and Howson

[57] ABSTRACT

A portable bench which is particularly suited for use by a shooter comprises top and front and rear leg assemblies pivotally connected thereto. The leg assemblies fold inwardly to provide a pocket for carrying a seat which is releasably connected to the leg assemblies when they are folded outwardly at the point of use. The bench top is inclined and is vertically and angularly adjustable. The bench top has a lateral recess which overlies the seat for accommodating the upper body of the shooter when seated on the seat. An adjustable gun rest is provided at the front of the bench top for supporting the forearm of the shooter's gun.

20 Claims, 10 Drawing Figures

PORTABLE SHOOTER'S BENCH

FIELD OF THE INVENTION

The present invention relates to portable benches, and more particularly, the present invention relates to portable benches which are particularly suited for use in target shooting.

BACKGROUND OF THE INVENTION

In target shooting, it is customary for shooters to sit alongside benches or tables located at various distances from targets posted in a shooting range. The benches have surfaces which support sandbags on which the forearm of the shooter's gun is placed, and shooting accessories such as a spotting scope, ammunition, and the like is often placed on the bench during shooting. The elevation of the gun is normally adjusted by stacking sandbags to various heights on the front of the bench. This type of bench is generally permanently installed at a shooting range.

Several attempts have been made to provide portable gun supports for use in shooting. Examples of such devices may be found in U.S. Pat. Nos.: 2,847,909; 3,711,984; and 3,863,376. In addition, a portable shooting bench is disclosed in the December 1981 issue of The American Hunter at pages 58 and 59. A portable take-down shooting bench is currently being marketed by REL Associates of Denver, Colo. Folding tables for other purposes are disclosed in U.S. Pat. Nos. 2,421,127 and 4,144,823.

While each of the aforementioned devices may function satisfactorily for its intended purpose, there is an ever present demand for a shooting bench which is capable of being folded into a compact configuration for carrying yet which is capable of being erected readily for use at the desired shooting location.

OBJECTS OF THE INVENTION

With the foregoing in mind, a primary object of the present invention is to provide a novel portable bench which is particularly suited for use in shooting.

A still further object of the present invention is to provide a portable shooter's bench in which a shooter can be seated comfortably in a desirable shooting position while shooting.

It is another object of the present invention to provide an improved portable bench having foldable legs and a removable seat which enables the bench to be transported in a folded configuration and erected quickly at the point of use.

As a further object, the present invention provides a portable shooting bench having a bench top to which is pivotally connected depending front and rear leg assemblies which are so dimensioned and connected to the top as to cause the top to be inclined upwardly in the forward direction and to be angularly adjustable.

Another object of the present invention is to provide a portable shooter's bench which is capable of supporting a shooter, his gun, and accessories useful in shooting.

As a still further object, the present invention provides a portable shooter's bench which is rugged in construction.

SUMMARY OF THE INVENTION

More specifically, the present invention provides a portable bench which is adapted to be transported in a folded configuration and assembled readily in an erect configuration for use by a shooter. The portable bench comprises an elongated bench top having front and rear ends to which are pivotally connected front and rear leg assemblies. The front leg assembly is longer than the rear leg assembly so that when the bench is erected, its top inclines upwardly toward the front. When the bench is folded, the leg assemblies cooperate with the top to form a pocket which receives a seat designed to be placed underneath the top and connected to the front and rear leg assemblies. The bench top has a lateral recess for accommodating the upper body of the shooter when seated on the seat which is narrower than the top and which underlies the recess in the top. The leg assemblies are connected to the top in a manner affording both pivotal movement and vertical and angular adjustability of the top. A vertically adjustable gun rest is provided at the front end of the top. The front leg assembly carries adjustable extensions. A carrying handle is provided on one of the leg assemblies to enable the bench to be carried like a suitcase when folded into its transport mode.

BRIEF DESCRIPTION OF THE DRAWINGS

The foregoing and other objects, features and advantages of the present invention should become apparent from the following description when taken in conjunction with the accompanying drawings, in which.

DESCRIPTION OF THE PREFERRED EMBODIMENT

Figure 1:
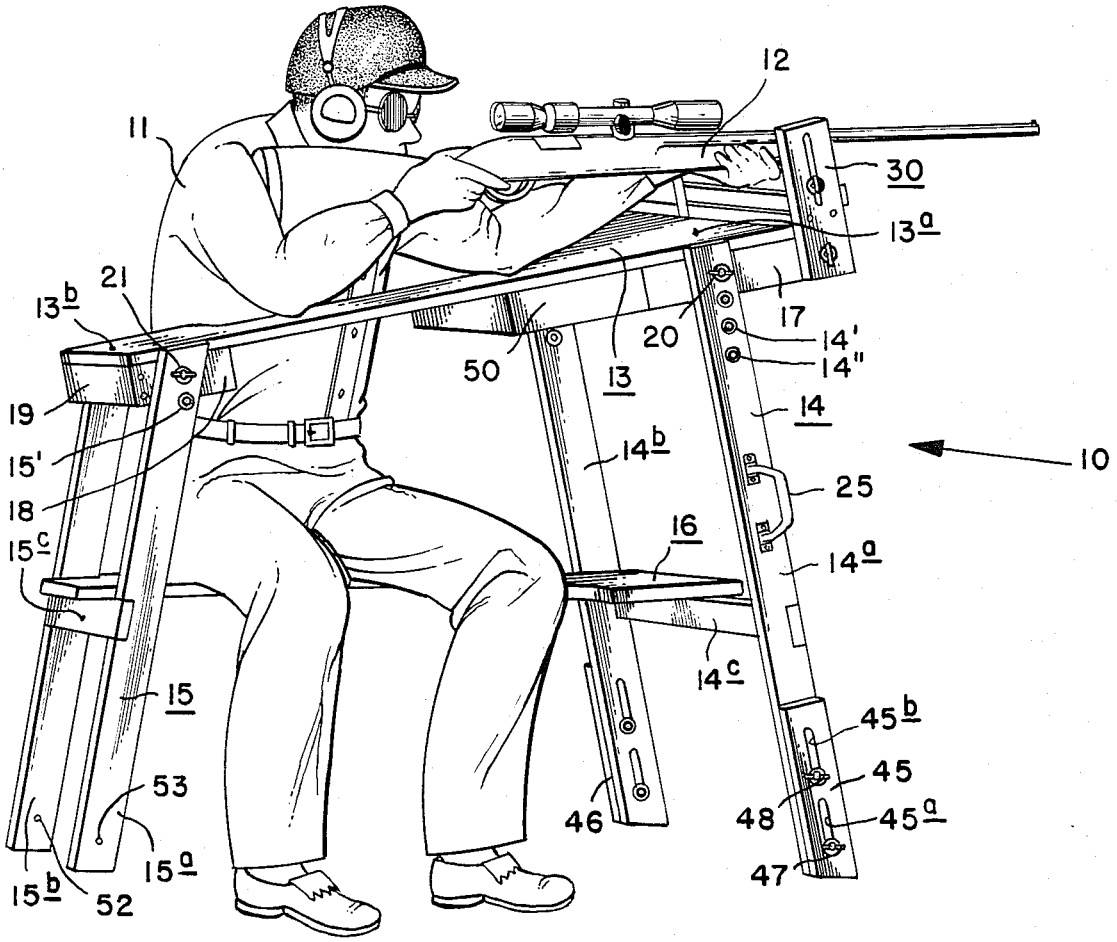
FIG. 1 is a perspective view illustrating the portable bench of the present invention being used by a shooter.

Referring now to the drawings, FIG. 1 illustrates a portable shooter's bench 10 which embodies the present invention. The bench 10 is illustrated in FIG. 1 in its erect usage configuration with a shooter 11 shown seated in the bench 10 aiming a gun 12 at a target. The bench 10 is designed to support the shooter's body at about a 45 degree angle with respect to the line of sight of the gun 12, thereby functioning in a well known manner to facilitate accurate shooting.

The major structural components of the bench 10 are its top 13, a front leg assembly 14 supporting the front of the top 13, a rear leg assembly 15 supporting the rear of the top 13, and a seat 16 extending substantially horizontally between the leg assemblies 14 and 15. The top 13 has a pair of depending flanges located at the front 13*a* of the bench 10, such as the depending flange 17 on the right side. The table top 13 also has a pair of depending flanges at the rear end 13b thereof, such as the flange 18 on the right side. Similar flanges are provided at the opposite side of the top 13. Preferably, stiffeners, such as the stiffener 19, connect the front and rear flanges to rigidify the same.

Figure 3:
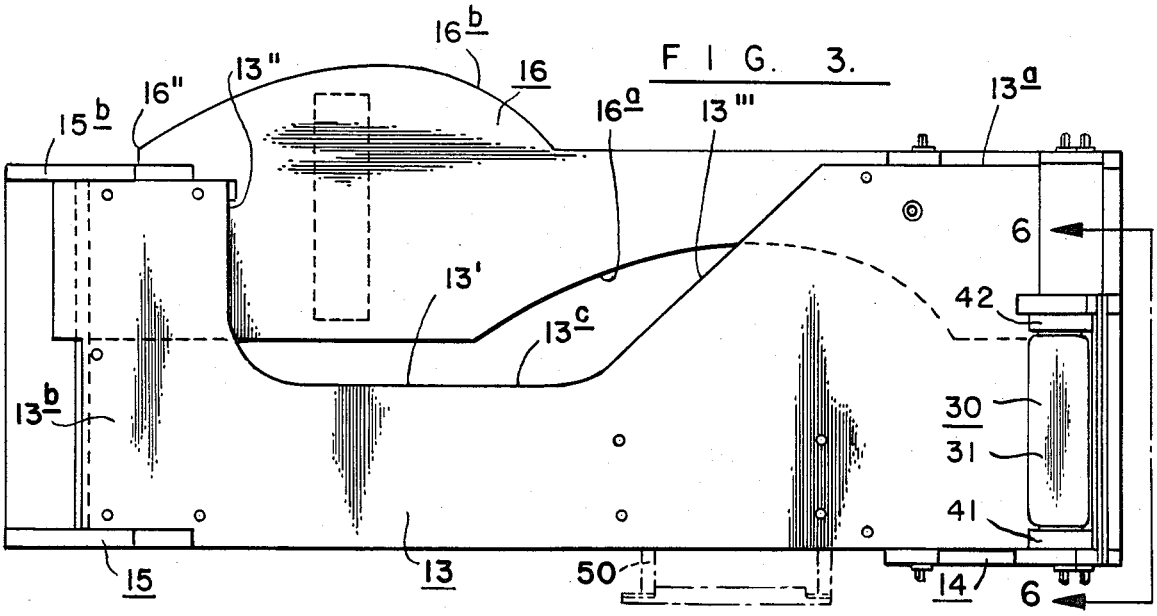
FIG. 3 is a plan view of the bench.

As best seen in FIG. 3, the top 13 has an elongated rectangular shape with four corners and with its front end 13a being slightly wider than its rear end 13b. The top 13 has a lateral recessed portion 13c which is for the purpose of accommodating the upper body of a shooter when seated in the bench 10 as illustrated in FIG. 1. The recessed portion 13c extends inwardly from the left edge to about the longitudinal median of the top 13. Preferably, the recess 13c has a straight portion 13' extending for about ¼ of the length of the top from an edge 13'' extending laterally inward adjacent the rear 13b of the top 13. A tapered edge 13''' extends laterally outward and forward to connect the straight portion 13' of the recess 13c with the edge at the front end 13a of the top 13. Preferably, the top 13 is fabricated of pressed wood, plywood or the like, and may have a top layer of birch or other desirable wood. A preferred top has a lengthwise dimension of about 48 inches, a widthwise dimension of about 17½ inches at the front and a widthwise dimension of about 16 inches at the rear.

Figure 2:
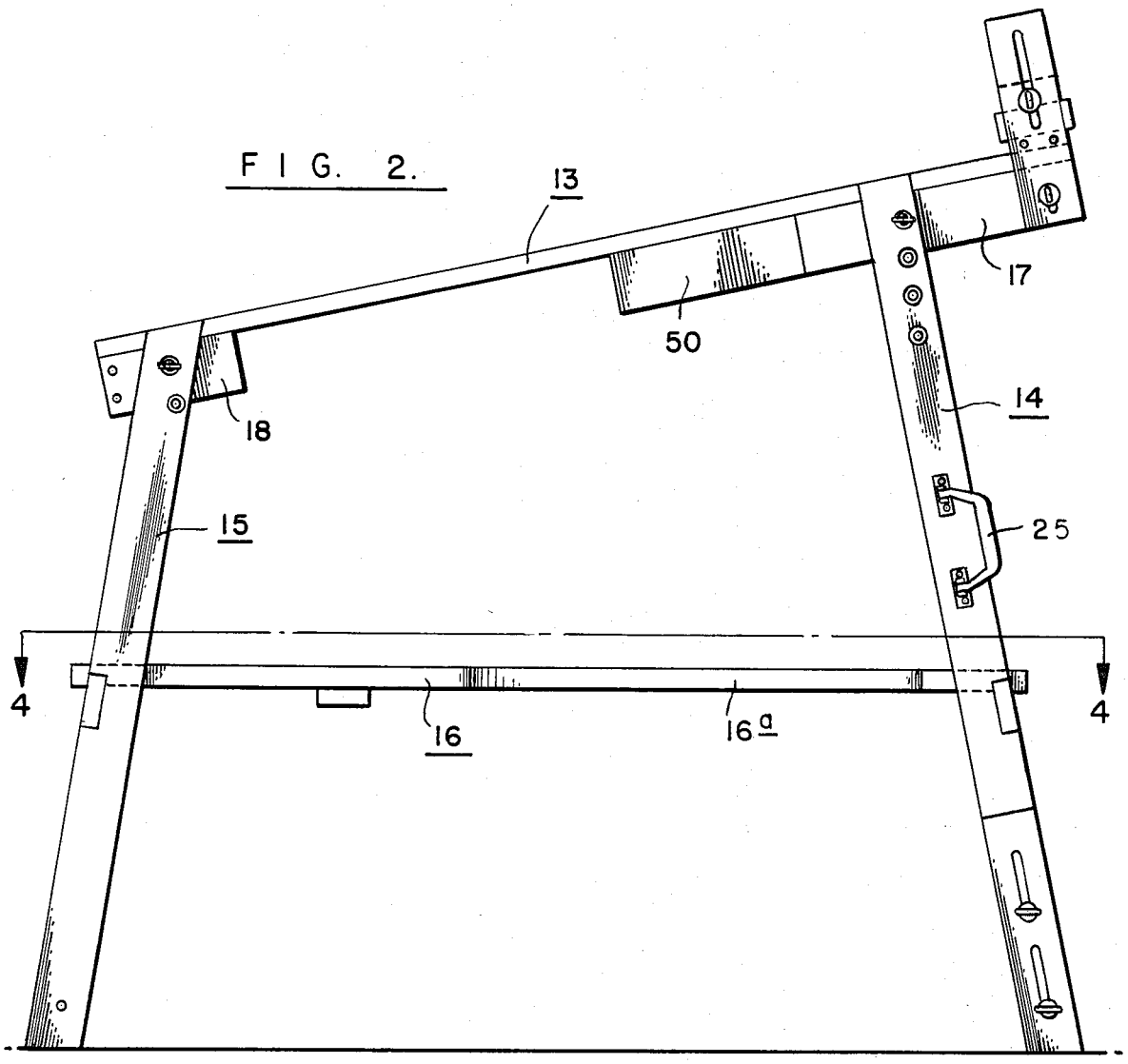
FIG. 2 is a side elevational view of the bench.

In the assembled bench 10, the top 13 preferably inclines upwardly at a slight angle from its rear end 13b to its front end 13a. To this end, the length of the front leg assembly 14 is greater than the length of the rear leg assembly 15. Thus, when the leg assemblies 14 and 15 are disposed in diverging relation as illustrated in FIG. 2, the front end 13a of the top 13 is disposed at a higher elevation than the rear end 13b thereof. A desirable angle of inclination has been found to range from about horizontal to about 10 degrees with respect to horizontal.

The front and rear leg assemblies 14 and 15 are pivotally connected to the top 13. To this end, and as best seen in FIG. 1, the front leg assembly 14 comprises a pair of legs 14a and 14b interconnected below the top 13 by a cross member 14c. The rear leg assembly 15 similarly has a pair of legs 15a and 15b interconnected below the top 13 by a cross member 15c. The upper end of each leg of the front leg assembly 14, such as the right leg 14a, is provided with a series of spaced holes 14', 14'' adapted to receive a thumb screw 20 which is threaded into a nut (not shown) fixedly mounted in the front top flange 17. Both legs 15a and 15b of the rear leg assembly 15 are provided with one or more holes, such as the hole 15', which receive a thumb screw 21 likewise threadedly received in a nut mounted in the rear top flange 18. The holes in the legs of the front and rear leg assemblies 14 and 15 are aligned to provide sets of common pivot axes at separate locations. The arrangement of holes 14', 14'' in the legs of the front leg assembly 14 enables the elevation of the front end 13a of the top 13 to be adjusted simply by removing the thumb screws 20 from one set of aligned holes in the legs 14a and 14b and replacing them in another set of the aligned holes in the legs 14a and 14b. Similarly, the height of the top 13 may be lowered by removing the thumb screw 21 from each of the legs 15a and 15b of the rear leg assembly 15 and placing them in aligned holes 15'. Thus, the top 13 can be adjusted both to lower the same (for smaller shooters) and to change the angle of inclination of the top 13 to suit the shooter's preference. The angle is adjustable from about horizontal to about 10 degrees with respect to horizontal, as illustrated in FIG. 2.

The front and rear leg assemblies 14 and 15 are pivotally connected to the top 13. For this purpose, the thumb screws 20 and 21 provide transverse pivot axes at the front and rear of the top 13. This enables the front leg assembly 14 to be pivoted rearwardly in the clockwise direction (FIG. 1) and the rear leg assembly 15 to be pivoted forwardly in the counterclockwise direction (FIG. 1). Because the width of the top 13 is greater at the front end 13a than at the rear end 13b, the spacing between the front legs 14a and 14b is greater than the corresponding spacing between the rear legs 15a and 15b. As a result, the rear legs 15a and 15b interdigitate within the confines of the front legs 14a and 14b, thereby permitting both sets of legs to be folded into proximity with respect to the top 13, diverging only slightly from the plane of the top 13.

Figure 9:
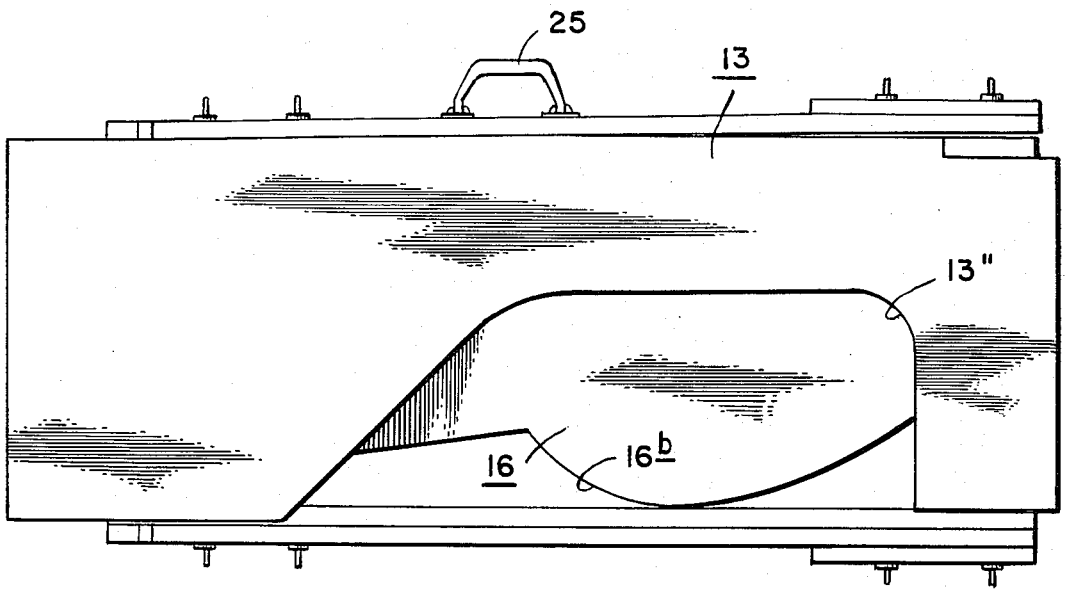
FIG. 9 is a view illustrating the bench folded in its transport configuration.
Figure 10:
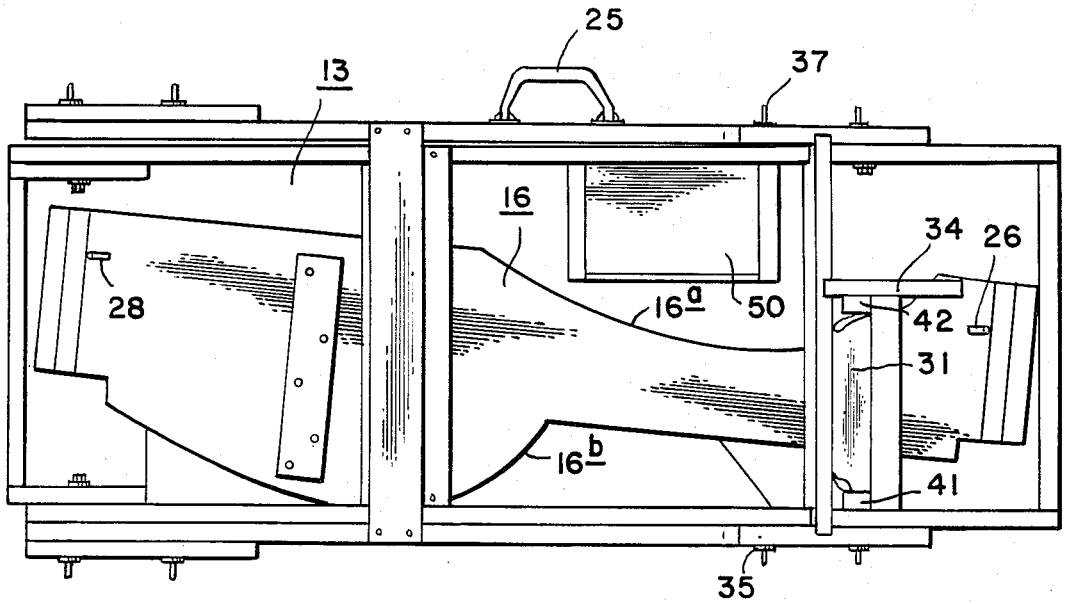
FIG. 10 is a view of the reverse side of the bench illustrated in FIG. 9 in its folded transport configuration.

When in the folded position, the leg assemblies 14 and 15 cooperate with the top 13 and its edge flanges to provide a pocket for receiving the seat 16, thereby enabling it to be carried as an assembled unit with the top and leg assemblies. See FIG. 10. Preferably, one of the legs of one of the leg assemblies, such as the right leg 14a of the front leg assembly 14 is provided with a handle 25 at about its midpoint to enable the bench 10 to be carried like a suitcase when folded in its transport configuration. See FIG. 9. Preferably, the thumb screws 20 and 21 are tightened after the leg assemblies 14 and 15 have been folded into one another in order to retain them in their folded relationship and to contain the seat 16, although if desired, an elastic cord may be wrapped around the bench in the zone of the handle to keep the legs folded.

Figure 4:
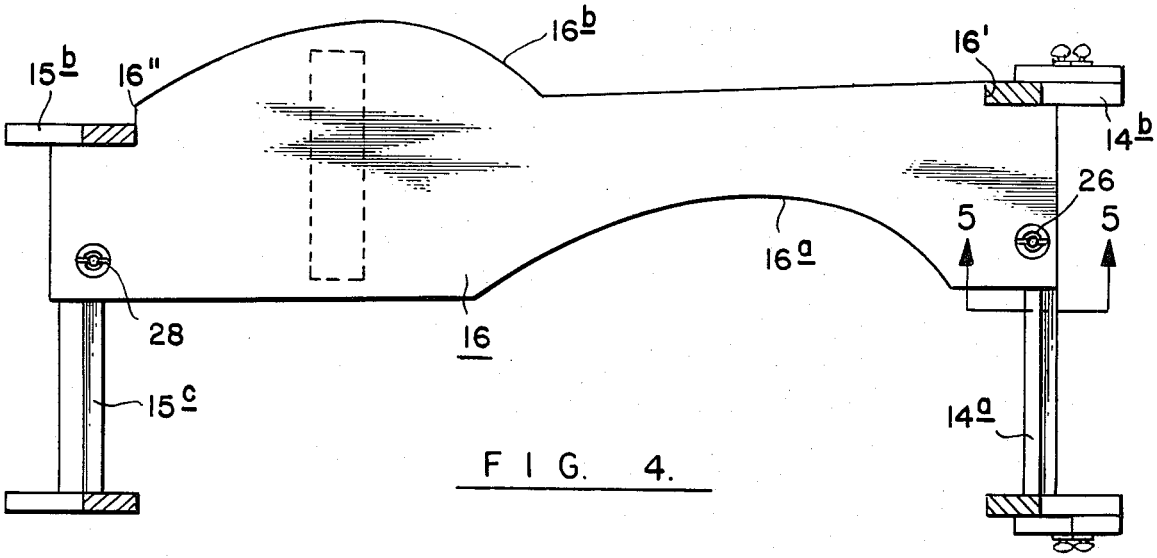
FIG. 4 is a sectional view taken on line 4—4 of FIG. 2.
Figure 5:
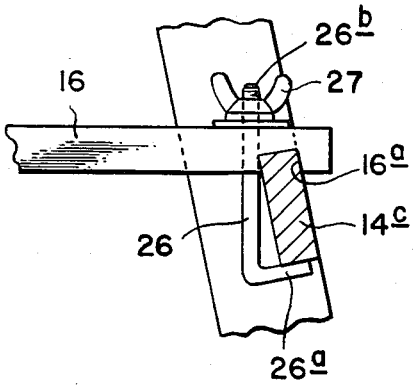
FIG. 5 is an enlarged fragmentary sectional view taken on line 5—5 of FIG. 4.

The bench 10 is sturdy. To this end, the seat 16 is releasably but securely connected to the front and rear leg assemblies 14 and 15, respectively. As best seen in FIGS. 4 and 5, the seat 16 is provided, at both its rear and front ends, such as the front end illustrated in FIG. 5, with a transverse groove 16a in its underside which engages the cross member 14c of the front leg assembly 14. The seat 16 is releasably clamped to the cross member 14c by an L-shaped bolt 26 having an inturned lower end 26a which engages the underside of the cross member 14c and a threaded shank 26b which projects upwardly through a hole in the seat 16 and threadedly receives a wing nut 27. The bolt 26 can be engaged and disengaged from the cross member 14c simply by loosening the wing nut 27 and rotating it about its shank. The rear end of the seat 16 is similarly connected to the rear cross member 15c by an L-shaped bolt and wing nut 28.

The bench 10 comfortably supports the shooter 11. To this end, the seat 16 is about half as wide as the bench top 10 and underlies its recess 13c as shown in FIG. 3. The seat 16 has an arcuate cut-away portion 16a located somewhat forwardly of its transverse median for enabling one of the shooter's legs, such as the left leg illustrated in FIG. 1, to be accommodated comfortably when the shooter 11 is seated in the bench 10 with his upper body in the top cut away 13c in the manner illustrated in FIG. 1. The seat 16 also has a lateral enlargement 16b located diametrically opposite the cut-away 16a for the purpose of supporting the buttocks of the shooter 11. As best seen in FIG. 4, the seat 16 is preferably notched at 16' and 16'' to engage the left legs 14b and 15b of the front and rear leg assemblies 14 and 15, respectively and to assist in rigidifying the erect bench. A space between the inner edge of the seat 16 and the recess 13c of the top 13 help to accommodate both the upper body of the shooter and his legs and enables him to sit in the bench 10 at a desirable 45 degree angle with respect to the direction of shooting.

Figure 6:
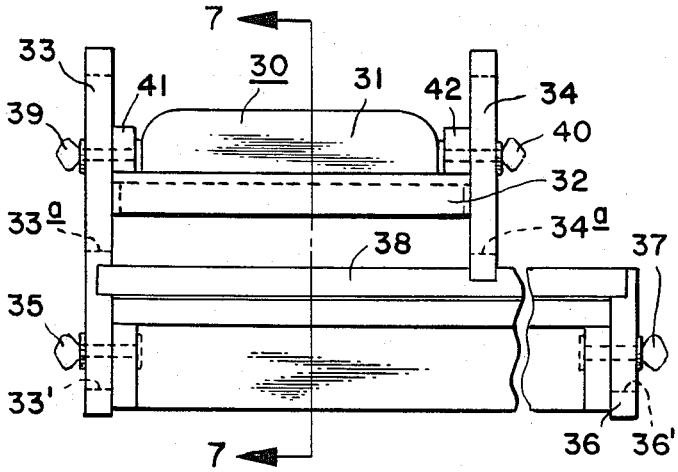
FIG. 6 is an enlarged fragmentary view of the gun rest mounted on the front of the bench.

In order to support the forearm of the gun 12 when the bench 10 is in use, a gun rest assembly 30 is provided. As best seen in FIG. 1, the gun rest assembly 30 is mounted adjacent the front end 13*a* of the top 13 and is vertically adjustable relative thereto. As best seen in FIG. 6 (sheet 3) the gun rest assembly 30 comprises a pad 31 mounted in a support cradle 32 which extends between uprights, or stanchions 33 and 34. The upright 34 projects upwardly at about the middle of the bench top from a transverse stringer 38 which extends widthwise of the bench top 13. The stringer 38 is fastened at its right-hand end to a bracket 36 which is pivotally connected to the top by a thumb screw 37 and is fastened at its left-hand end to the upright 33, the lower end of which is connected to the bench top by a thumb screw 35. The thumb screws 35 and 37 pass through slots 33' and 36' which permits the entire assembly 30 to pivot forwardly around the front edge of the top and into an out of the way position should such be desired.

Figure 7:
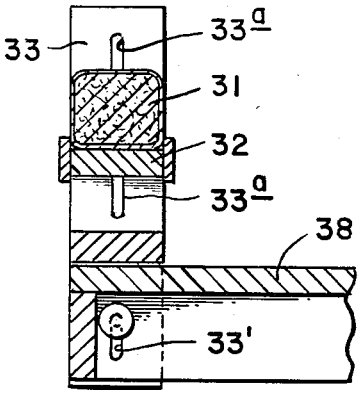
FIG. 7 is a sectional view taken on line 7—7 of FIG. 6.
Figure 8:
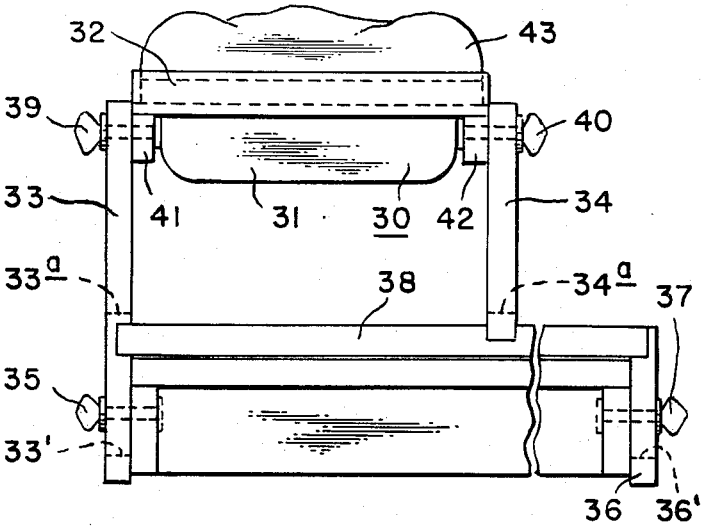
FIG. 8 is a view similar to FIG. 6 but illustrating the gun rest in a different adjusted position.

To afford vertical adjustability of the pad 31, the uprights 33 and 34 are provided with vertically elongated slots 33*a* and 34*a*, respectively. The slots 33*a* and 34*a* receive thumb screws 39 and 40 which are threadedly received by blocks 41 and 42 carried by the support cradle 32. The thumb screws 39 and 40 cooperate with the slots in the uprights 33 and 34 both to permit the vertical elevation of the pad 31 to be adjusted and to permit the support 31 to be pivoted, or even to be inverted in the manner illustrated in FIG. 8 for receiving a sandbag 43 should it be desirable to use a sandbag in lieu of the pad 31. As best seen in FIG. 7, the support cradle 32 has an H-shaped transverse cross section, the upper portion of which receives the pad 31 and the lower portion of which provides a channel for receiving the sandbag 43.

In order to enable the bench 10 to be used on uneven terrain and/or to afford greater vertical adjustment of the front end 13*a* of its top 13, means is provided on the front leg assembly 14 to extend the length thereof. In the illustrated embodiment, the extension means includes a pair of extension members 45 and 46 disposed alongside the lower portions of the front legs 14*a* and 14*b*, respectively. Each extension, such as the right-hand extension member 45, is provided with a pair of elongated vertically aligned slots 45*a* and 45*b*. A pair of thumb screws 47 and 48 extend through the slots 45*a* and 45*b* to threadedly engage nuts (not shown) carried by the lower portion of the leg 14*a*. The left-hand member 46 is similarly mounted. Thus, by loosening the thumb screws 47 and 48, the extension member 45 may be extended or retracted relative to the leg 14*a*. Thus, when the desired amount of extension has been obtained, the thumb screws 47 and 48 can be tightened to lock the extension member 45 in its adjusted extended position. The left-hand plate 46 is similarly mounted and adjusted.

The gun rest assembly 30 is securely and safely stowed for transport. To this end, the rear legs 15*a* and 15*b* are provided with nuts 52 and 53 adjacent their lower ends so that the gun rest assembly 30 can be engaged with the lower ends of the legs 15*a* and 15*b*, and the thumb screws which had been used to fasten the gun rest assembly 30 to the top 13, threadedly received in the nuts 52 and 53 for securing the gun rest assembly 30 in the manner illustrated in FIG. 10. In the illustrated position, the pad 31 is shown inverted and placed against the stringer 38. It is noted that the seat 16 is retained in the pocket between the top 13 and the leg assemblies 14 and 15 by means of their respective cross members 14*c* and 15*c* and the stringer 38 of the gun rest assembly 30.

For the purpose of accommodating shooting paraphernalia, such as ammunition, pencils, tape, etc., a drawer 50 is mounted to the underside of the top 13 rearwardly adjacent the front leg assembly 14. The drawer 50 opens laterally rightward from a position contained completely within the periphery of the table top 13 to a laterally extended position such as indicated in broken lines in FIG. 3. The drawer 50 is located in such a position that the right-hand leg 14*a* of the front leg assembly 14 lays against the outside of the drawer 50 when the front leg assembly 14 is folded, thereby maintaining the drawer closed while the bench 10 is being transported.

To use the bench 10, a shooter grips the handle 25 and carries it like a suitcase from its storage location to a shooting range where the thumb screws 35 and 37 are disconnected. This releases the gun rest assembly 30 which is temporarily laid aside. The front and rear leg assemblies 14 and 15 are then pivoted outwardly into the position illustrated in FIGS. 1 and 2, and the seat 16 is laid across the cross members 14*c* and 15*c* with the notches in the underside of the seat 16 engaged with the cross members 14*c* and 15*c*. The L-bolts are then pivoted into engagement with the underside of the cross members 14*c* and 15*c*, and the wing nuts 27 and 28 thereon rotated to clamp the seat 16 to the front and rear cross members. The gun rest assembly 30 may then be installed on the front end 13*a* of the top 13 in the manner illustrated in FIGS. 1 and 6. The shooter may then adjust the angle of inclination of the top 13 by disengaging the thumb screws 20 connecting the front legs 14*a* and 14*b* to the top and replacing them in any selected one of the holes 14', 14'' in the legs of the front leg assembly 14. Of course, the height of the table 13 may also be adjusted by similarly removing the thumb screws 21 from the rear legs 15*a* and 15*b* and replacing them in the lower hole 15'. Should the terrain be uneven, the front leg extensions 45 and 46 may be adjusted in the manner described heretofore.

When shooting from the bench 10, the shooter 11 sits on the seat 16 and places the forearm of the gun 12 on the gun support pad 31. Because the front end 13*a* of the top 13 is elevated, the shooter is more comfortable when shooting due to his forearm resting more naturally on the forward part of the top 13 and his other arm and elbow resting on or alongside the rear portion of the top 13. The elevation of the gun 12 may be raised or lowered simply by adjusting the height of the pad 31 in the manner noted heretofore.

In view of the foregoing, it should be apparent that the present invention now provides an improved portable shooting bench which is capable of being transported in a relatively compact configuration and which is capable of being erected readily at the shooting range. The bench is rugged and sturdy when erected. The bench can be made to accommodate either right-hand or left-hand shooters simply by varying the relative locations of the cut-aways in the top and seat. Preferably, the bench is fabricated of wood. If desired, an extension may be mounted at the front of the bench top 13 to enable the bench 10 to be used comfortably by shooters using long-barreled muzzle-loaders.

While a preferred embodiment of the present invention has been described in detail, various modifications, alterations and changes may be made without departing from the spirit and scope of the present invention as defined in the appended claims.

What is claimed is:

1. A portable bench adapted to be transported in a folded configuration and assembled readily in an erect configuration for use in shooting, comprising:

an elongated bench top having front and rear ends and elongated side edges intersecting said ends to define four corners and a lateral recess in at least one of said side edges between said ends, a front leg assembly pivotally connected to said bench top adjacent its front end, a rear leg assembly pivotally connected to said bench top adjacent its rear end, said front leg assembly being longer than said rear leg assembly for causing said bench top to incline upwardly from rear to front when said bench is erected, said front and rear leg assemblies being sized with respect to one another to interdigitate into proximity with said top when said bench top and leg assemblies are arranged in their folded transport configuration, a seat disposed directly below said lateral recess in said bench top and extending between and removably supported by said front and rear leg assemblies when said bench is errected, said seat being vertically below and substantially within the area encompassed by the four corners of the bench top when said bench is erected, and means releasably connecting said seat to said leg assemblies, said lateral recess in said bench top cooperating with the seat therebelow to enable a person to sit in the bench with his upper body disposed substantially entirely within the recess of the bench top and at about a 45° angle with respect to the length of the bench top when shooting a firearm, whereby the inclination of the bench top and angular disposition of the person's body with respect thereto aid the person in aiming the firearm naturally.

2. The portable bench according to claim 1 including releasable means providing said pivotal connection of said front leg assembly at spaced locations along its length to permit the angle of inclination of the bench top to be adjusted.

3. The portable bench according to claim 2 including releasable means providing said pivotal connection of said rear leg assembly at spaced locations along its length to afford height adjustment of the bench top.

4. The portable bench according to claim 3 wherein said front and rear leg assembly adjustment means includes a plurality of aligned holes in said leg assemblies, and thumb screws extending through selected aligned ones of said holes for engaging said bench top and providing a pivot axis transverse to said bench top.

5. The portable bench according to claim 1 wherein each leg assembly includes a pair of legs and a cross member connecting the legs in each pair, and said releasable seat fastening means includes front and rear grooves in the underside of said seat engaging the leg assembly cross members and means for clamping said seat to said cross members.

6. The portable bench according to claim 5 wherein said seat clamping means includes an L-shaped bolt having an inturned end engaging the underside of the cross member and a shank extending through a hole in said seat.

7. The portable bench according to claim 1 including means providing a handle at one side of said bench top to afford carrying of said bench in its folded configuration.

8. The portable bench according to claim 1 including means carried by said front leg assembly affording lengthwise extension thereof.

9. The portable bench according to claim 8 wherein said front leg assembly includes a pair of legs, and said extenion means includes a pair of members disposed alongside said legs and releasable friction lock means affording sliding movement of said members relative to said legs to provide a secure connection thereto at selected adjusted positions.

10. The portable bench according to claim 1 including a gun rest adapted to be removably mounted adjacent the front end of said bench top.

11. The portable bench according to claim 10 wherein said gun rest includes gun support, and including means mounting said gun support for adjustable vertical movement relative to said front end of said bench top.

12. The portable bench according to claim 11 wherein said vertical adjustment means includes a pair of upstanding stanchions each having a slot therein with said gun support extending across the front end of said table between said stanchions, and means frictionally locking said gun support to said stanchions at selected vertical positions.

13. The portable bench according to claim 12 wherein said friction locking means includes a pair of thumb screws extending through said slots in said stanchions on a common axis and threadedly engaged with said gun support, whereby said support can be pivoted about said axis.

14. The portable bench according to claim 13 including a pad mounted to one side of said gun support, and means defining a channel in the other side of said support adapted to receive a sandbag when the gun support is inverted.

15. The portable bench according to claim 1 including a drawer mounted to the underside of said bench top adjacent one end and slidable laterally with respect thereto.

16. A portable bench capable of being folded into a transport configuration and assembled readily in an erect configuration for use in shooting, comprising:

an elongated bench top having front and rear ends and elongated side edges intersecting said ends to define four corners and a lateral recess in at least one side edge for accommodating the upper body of a shooter using the bench, front and rear leg assemblies pivotally connected to the bench top adjacent its front and rear ends, respectively, said front leg assembly being longer than said rear leg assembly to cause said bench top to incline toward the front when in its erect usage configuration, said leg assemblies being foldable toward one another into proximity with said bench top and forming a pocket therebetween when the bench is in its transport configuration, a seat adapted to fit into said pocket for transport and to be disposed below said bench top when the bench is in its erect configuration, said seat being vertically below and substantially within the area encompassed by the four corners of the bench top when said bench is erected, said seat having a width about one-half the width of said bench top and spanning between said leg assemblies and being supported thereon, said seat being disposed directly underneath the side of the bench top having the recess for supporting the upper body of the shooter substantially entirely within the recess of the bench top, and means releasably connecting said seat to said leg assemblies.

17. The portable bench according to claim 16 wherein said seat has a lateral enlargement on one side for supporting a shooter's buttocks and a lateral cut-away located diagonally on the opposite side for receiving a shooter's leg, said seat cut-away being disposed toward the front end of the bench when installed therein for cooperating with the bench top recess to enable a shooter to sit in the bench and to shoot with his body disposed at about a 45 degree angle with respect to the lengthwise dimension of the bench top.

18. The portable bench according to claim 16 including means on said front and rear leg assemblies and said bench top affording both vertical and angular adjustability of said bench top.

19. The portable bench according to claim 16 including means providing a vertically adjustable gun rest at the front end of said bench top for supporting a gun when the bench is in use.

20. A portable bench capable of being folded into a transport configuration and assembled readily into an erect configuration for use in shooting, comprising:

an elongated bench top having front and rear ends and elongated side edges intersecting said ends to define four corners and a lateral recess in at least one of said side edges for accommodating the upper body of a person using the bench, front and rear leg assemblies pivotally connected to said bench top adjacent said front and rear ends; respectively, said front leg assembly being longer than said rear leg assembly to incline said bench top when said bench is erected, one end of said bench top being wider than the other and said leg assemblies being correspondingly dimensioned to fold inwardly toward one another into proximity with said bench top and to form a pocket therebetween, a seat adapted to fit within said pocket for transport and to be connected to said leg assemblies when said bench is erected, said seat being vertically below and substantially within the area encompassed by the four corners of the bench top when said bench is erected, said seat being about one-half the width of said bench top and having a cut-away located forwardly of said bench top recess for accommodating a leg of the shooter when seated thereon with his upper body positioned substantially entirely within the bench top recess, means releasably connecting said seat to said leg assemblies, means providing a vertically-adjustable gun rest adjacent to the front end of said bench top, and means providing a handle on one of said leg assemblies at about the middle thereof to enable the bench to be carried readily when folded.

* * * * *